United States Patent [19]

Comier et al.

[11] Patent Number: 5,045,126

[45] Date of Patent: Sep. 3, 1991

[54] PROCESS AND EQUIPMENT FOR THE HEAT TREATMENT, BEFORE HARDENING, OF METALLIC PIECES BY CEMENTATION, CARBONITRIDATION OF HEATING

[75] Inventors: Alain Comier, Montreal, Canada; Patrice Ollivier; Jean-Marc Viant, both of Paris, France

[73] Assignee: L'Air Liquide, Societe Anonyme Pour L'Etude et L'Exploitation des Procedes Georges Claude, Paris, France

[21] Appl. No.: 452,432

[22] Filed: Dec. 19, 1989

[30] Foreign Application Priority Data

Dec. 20, 1988 [FR] France ..... 88 16792

[51] Int. Cl.[5] ..... C21D 1/00

[52] U.S. Cl. ..... 148/13; 266/251; 266/257

[58] Field of Search ..... 266/80, 81, 257, 44, 266/251; 148/13

[56] References Cited

U.S. PATENT DOCUMENTS 4,279,406 7/1981 Bourhis et al. ..... 266/81
4,805,881 2/1989 Schultz et al. ..... 266/81

OTHER PUBLICATIONS

Iron and Steel Engineer, vol. 39, No. 8, Aug. 1962, pp. 124–134; R. Herbert et al.: "Nitrogen Form an Air Separation Plant as a Heat-Treating Atmosphere".
Metal Progress, vol. 127, No. 6, May 1985, p. 67, Metals Park, Ohio, US; "New Products: New Air Separation Technology Makes Nitrogen for Heat Treating".
Journal of Heat Treating, vol. 5, No. 2, 12/1988, pp. 97–114, Springer—Verlag New York Inc., N.Y., U.S., J. Stycke et al.: "Assessment of Nitrogen Base Atmospheres for Industrial Heat Treating".
Steel in the U.S.S.R., vol. 15, No. 12, Dec. 1985, pp. 610–611, Londres, GB; V. M. Rebikov: "Single-Compocomponent Controlled Atmosphere in Muffle-Less Shaft Type Electric Furnace".

*Primary Examiner*—S. Kastler
*Attorney, Agent, or Firm*—Browdy and Neimark

[57] ABSTRACT

The invention is exclusively concerned with heat treatments before hardening, of metallic pieces, by cementation, carbonitridation and heating. The process concerns the feeding of a non muffle heat treatment furnace with various components including nitrogen which is produced by an adsorption or selective permeation generator and which has a residual oxygen content of the order of 2%. According to the invention, after the furnace has ceased to be in operation for a substantial period of time, it is reconditioned by injecting purer nitrogen which has a residual oxygen content lower than 0.3% and which is produced by said generator, adjusted at a lower extraction rate.

9 Claims, 1 Drawing Sheet

PROCESS AND EQUIPMENT FOR THE HEAT TREATMENT, BEFORE HARDENING, OF METALLIC PIECES BY CEMENTATION, CARBONITRIDATION OF HEATING

BACKGROUND OF INVENTION (a) Field of the Invention

The present invention concerns the heat treatments of steels before hardening, by cementation, carbonitridation and heating, in order to provide a superficial hardening of metallic pieces.

(b) Description of Prior Art

In the past, the gaseous atmospheres used during cementation, carbonitridation and heating before hardening, of steels were mostly obtained from endothermic type gas generator apparatuses.

A typical example of the composition of an atmosphere for cementation is given below:

nitrogen ($N_2$): 40 %
carbon monoxide (CO): 19 %
carbon dioxide ($CO_2$): 0.3 %
hydrogen ($H_2$): 35 %
methane ($CH_4$): 1 %
water vapor ($H_2O$): 0.6 %
oxygen ($O_2$): traces For carbonitridation, similar atmospheres are used, to, which ammonia ($NH_3$) has been added which makes it possible to add nitrogen to the metal.

Presently, a proportionately high number of cementation, carbonitridation or heating plants, before hardening, of steels use industrial gases for producing their atmospheres, in preference to endothermic generators. In this case, the atmospheres resulting from the injection of a mixture of $N_2$, $CH_3OH$ (methanol), in some cases $CH_4$, and $NH_3$ in the case of carbonitridation, are prepared inside the furnaces.

Nitrogen can be obtained from:

- a cryogenic plant generally located far from the user, and in this case it is delivered in gaseous form (compressed bottles) or as a liquid (storage in liquid form and vaporization before use).
- a non cryogenic generator located directly at the client, which is either an adsorption generator known under the name "PSA", or a generator operating by gaseous permeation, or with "membranes" for example, which is economically interesting as compared to nitrogen of cryogenic origin, but which causes problems because of the relative impurity of the gas obtained, in particular because the oxygen content is relatively high, generally of the order of 0.1 to 5 %.

If there is no additional purification, the raw nitrogen obtained is therefor impure, because it contains a small portion of oxygen and traces of water. To limit the quantity of oxygen and water, the coefficient of extraction of the generator should be lowered (flow of nitrogen obtained/flow of air treated), and its production capacity is also lowered, which is obviously detrimental to the cost of the gas treated.

By way of example, a generator of the "PSA" type usually has the following performance data as a function of the content of oxygen in the gas obtained.

| Concentration $O_2$ (%) | 5% | 1% | 0.1% |
|---|---|---|---|
| Production ($m^3$/h) | 180 | 100 | 35 |

However, for cementation and carbonitridation, a residual concentration of oxygen of the order of 2% in the nitrogen used for the $N_2$—$CH_3OH$ mixtures appears suitable, since a higher concentration would cause problems in trying to obtain an atmosphere with a high carbon potential without formation of soot, while with a lower concentration, an adsorption or permeation generator would be of lesser interest on a cost point of view.

On the other hand, it should be mentioned that most of the treatments of steels, before hardening, by cementation, carbonitridation and heating are carried out in non muffle furnaces, i.e. with a simple partition of refractory bricks, without metallic partition, or muffle, so that the atmosphere inside the furnace is in direct contact with the refractory bricks which constitute the thermic insulation of the furnace. Now, refractory bricks are porous and act as sponges with respect to the atmosphere.

When such a furnace is in operation, the residual oxygen is converted into, CO, $H_2O$ and $CO_2$. The additional hydrocarbon makes it possible for example, to preserve a low content of $H_2O$ and $CO_2$ in spite of the presence of oxygen in the nitrogen, provided that the oxygen content is not too high. If this is not the case, an additional quantity of hydrocarbon which is qualified as excessive must be injected, because it can produce soot, heterogeneous cementations, and can be responsible for lowering the CO content. At the limit, it may be impossible to obtain a high potential of carbon in the atmosphere, which is obviously contrary to a good treatment.

The maximum content of oxygen in nitrogen which is compatible with most of the treatment cycles necessary during cementation, carbonitridation and heating, before hardening, of steels is of the order of 2%. In this case, the residual contents of $H_2O$ and $CO_2$ can be kept at low values, generally lower than 0.6% in the case of $H_2O$ and 0.3% in the case of $CO_2$.

However, the atmosphere which is formed inside the furnace diffuses in the refractory bricks and an equilibrium is reached at the interface bricks/atmosphere when the furnace operates continuously. However, an important problem remains during the periods when the furnace does not operate. Indeed, it happens more and more that the heat treatment plant is interrupted for relatively long periods of time, for example during the week-end. In this case, the treatment atmosphere obviously ceases to be injected in the furnace not only for economical reasons but also for safety reasons because it is potentially explosive (high content of hydrogen and CO) and toxic (high content of CO). On the other hand, the temperature of the furnace is often also somewhat lowered.

If no atmosphere is injected into the furnace, the latter tends to be filled with air which then diffuses through the refractory bricks. When the treatment is resumed, the air which is present in the furnace as well as in the refractory bricks must be flushed. This operation is long, and therefore costly, and is detrimental to the production. It is therefore usual to try to protect the furnace from air pollution during a period of non production, and for this purpose, the openings and the furnace are closed and a small flow of nitrogen, generally between 1/6 and 1/3 of the nominal flow, is injected in the furnace to maintain an over pressure preventing entry of air.

If the nitrogen used is derived from a cryogenic source, the residual content of oxygen in the furnace and in the refractory bricks remains very low., and the starting up of the furnace to resume production, called a period of reconditioning, is then very short, generally of the order of 15 minutes to a few hours depending for example on the temperature of the furnace.

If the nitrogen originates from another source and contains for example 2% oxygen, which amount is compatible with a later treatment and is particularly economical, the reconditioning of the furnace can be much longer, to the detriment of the productivity of the equipment. As a matter of fact, it is not only necessary to flush the atmosphere inside the furnace, but also the atmosphere which is present in the refractory bricks. This operation is particularly lengthy, since the bricks act as sponges and it is particularly difficult to diffuse gas therethrough. Moreover, flushing can be carried out in a known manner with the treating atmosphere which is again injected into the furnace. The latter contains a particularly high amount of hydrogen. This gas, which consists of a very "small" molecule diffuses very rapidly, so that hydrogen converts oxygen which is present in the refractory bricks into water vapor, to the extent that the water vapor content thus produced reaches 4%. This 4% content of water vapor is incompatible with the latter treatment which requires values lower than 0.6%. The water vapor must therefore be chemically destroyed or flushed. The flushing of water vapor is an operation which is always difficult since this polar molecule has the property of being very easily adsorbed at the surface of solid materials. On the other hand, refractory bricks, because of their porosity, have a very high specific surface.

The chemical destruction of water vapor is eventually carried out by reaction with a hydrocarbon such as methane, but this reaction is very slow or even nearly nonexistent the temperature is lower than 600° C., which comes rapidly in the case of refractory bricks, since there is an important temperature gradient between the interior of the furnace and the outside partition thereof, whose temperature is generally lower than 100° C. in a normal furnace.

SUMMARY OF THE INVENTION

In view of the above, the invention concerns a process for the heat treatment, before hardening, of metallic pieces, by cementation or carbonitridation or heating, of the type in which there is used an additional gaseous mixture based on nitrogen, methanol, possibly ammonia, to constitute a treatment atmosphere in a furnace of the type utilizing a simple partition of refractory bricks, wherein as nitrogen component, there is used raw nitrogen produced by separation from air with an adsorption or permeation generator, wherein the degree of purity of nitrogen, or the residual content of oxygen, is determined by its rate of extraction and which is adjusted so as to generate, while in operation, a nitrogen gas having a residual content of oxygen of the order of 2%, and wherein a restart of the treatment after an interruption of significant length is preceded by an injection of nitrogen into the furnace, this process being characterized in that flushing nitrogen is supplied, at a flow substantially lower than the treatment flow originating from the generator of nitrogen used for the treatment per se, which is adjusted for this purpose to a lower extraction rate, such that the residual content of oxygen does not exceed 0.3% and preferably is between 0.1% and 0.2%.

Experience has shown that a residual content of oxygen in the flushing nitrogen of the order of 0.3% or lower, for example of the order of 0.1 to 0.2%, cannot react with hydrogen to produce enough water vapor, which would be incompatible with the latter treatment.

The process according to the invention has the double advantage of not requiring another source of gas for the flushing operation, and to ensure this flushing under economical conditions which are the least detrimental to the exploitation yield of the equipment for cementation, carbonitridation, or heating before hardening.

The invention is also concerned with apparatus for the heat treatment, before hardening, of metallic pieces, by cementation, carbonitridation or heating, of the type comprising: a non muffle treatment furnace, i.e. with a single partition of refractory bricks, various sources of fluid components intended to constitute an atmosphere for the heat treatment, before hardening, by cementation, carbonitridation, or heating, among which, for the nitrogen component, a generator for separating nitrogen from air by adsorption or selective permeation, this equipment being characterized by means to adjust the rate of extraction of nitrogen on at least two levels, namely a high level with a residual content of oxygen of the order of 2% and a lower level with a residual content of oxygen lower than 0.3%, preferably between 0.1% and 0.2%.

BRIEF DESCRIPTION OF THE DRAWINGS

The single figure is a schematic representation of an equipment according to the invention.

DESCRIPTION OF PREFERRED EMBODIMENTS

Figure 1:
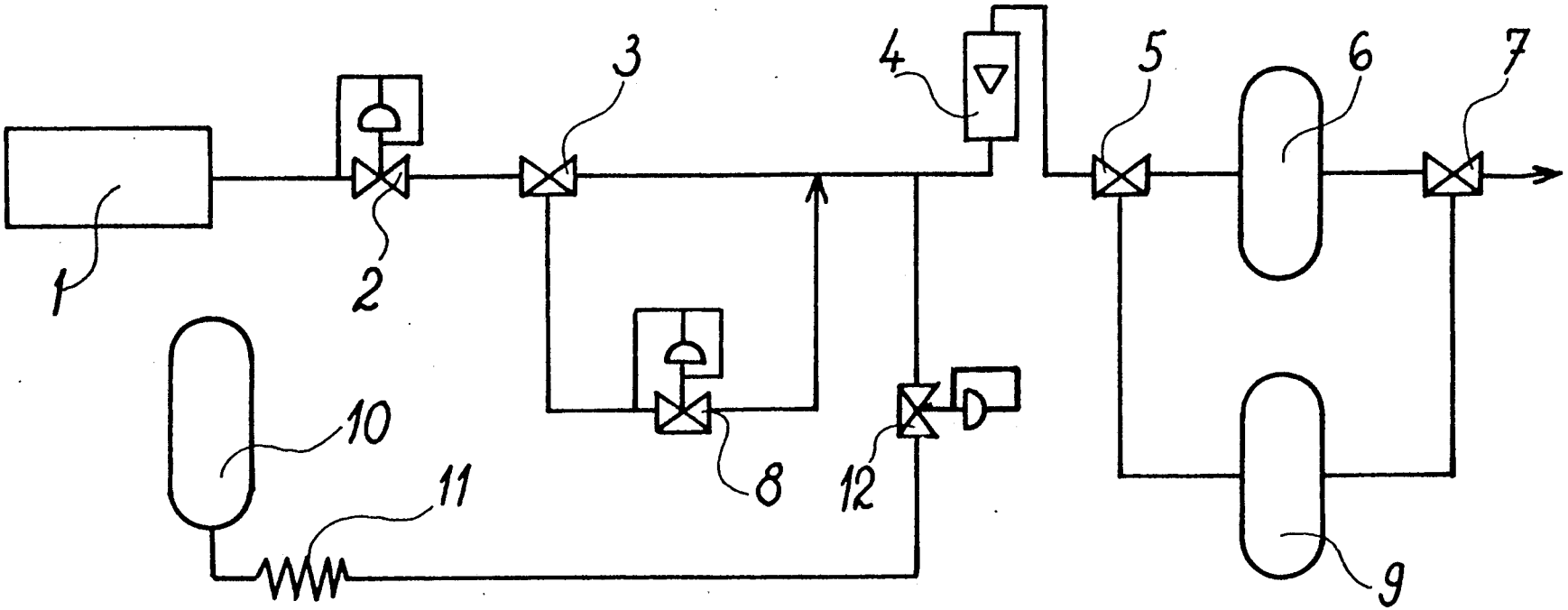

In the drawings, there is described:

In normal operation, the gaseous flow produced by generator 1 circulates through flow regulator 2, three way valve 3, flow-meter 4, a second three way valve 5, a main buffer-tank 6, and a third three way valve 7.

In operation, while flushing under reduced flow, when reconditioning the furnace, the gaseous flow obtained circulates through flow regulator 2, three way valve 3, flow reducer 8, flow-meter 4, three way valve 5, auxiliary tank for flushing gas 9, the three way valves 5 and 7 then being adjusted to prevent a flow through tank 6.

A storage of liquid nitrogen 10, provided with its vaporization device 11 and a pressure reducer 12, opens on the feed line directly upstream of the flow-meter 4 and is used to ensure the chopping of the extreme points and assists in case the generator stops.

The buffer-tanks 6 and 9 are used to absorb the flow variations called for by the user, respectively in normal operation or in reduced operation. These are not required if the flow which is called for is stable.

It will be noted that the three way valves 3, 5 and 7 can be manually operated by the user depending on his needs or automatically operated by an appropriate device (timer, detection of load of the client, . . . ).

The apparatus described ensures a substantial instantaneous flow with the help of the emergency pressure reducer 12 whatever the flows which circulate in tanks 6 and 9.

It will be observed that a single flow-meter is used, that there is only one single pressure reducer and that this flow-meter remains protected from over flows by means of downstream tanks 6 and 9.

A single buffer-tank should be sufficient. However, flushing of the buffer-tank should necessarily takes place during about the period of time required for the generator to go from normal nitrogen to flushing nitrogen.

As the reduced operation when reconditioning the furnace requires a little less compressed air for feeding the generator, the excess of compressed air as compared to the normal operation is either sent to the atmosphere, without any effect on energy saving, or the device used to put the compressor under vacuum is started at regular intervals, thus contributing to a substantial saving of energy.

By way of example, the following values can be mentioned:

| | | |
|---|---|---|
| $O_2$ content in nitrogen | 2% | 0.1% |
| nominal flow of a "PSA" type generator ($m^3/h$) | 100 | 25 |
| nominal power of the "PSA" type generator (kW) | Pn | 90% Pn |

We claim:

1. A process for heat treating metallic pieces by cementation, carbonitridation, or heating, before hardening, under a treating atmosphere comprising nitrogen and methanol, in a treatment furnace having unlined walls of refractory bricks, comprising:

producing raw nitrogen by separation of nitrogen from air by adsorption through a permeation generator whereby is provided, in normal full flow operating conditions, a nitrogen gas having a residual content of oxygen of about 2%.

prior to restarting the treatment after an interruption of significant duration, introducing flushing nitrogen gas into the furnace at a flow which is substantially lower than the normal operating flow of said generator; and accordingly adjusting said generator at a lower extraction rate such that the residual content of oxygen in said flushing nitrogen does not exceed 0.3%.

2. The process according to claim 1 wherein the residual content of oxygen in said flushing nitrogen is between 0.1% and 0.2%.

3. Apparatus for heat treatment of metallic pieces before hardening by cementation, carbonitridation or heating, comprising:

a treatment furnace having unlined walls made of refractory bricks;

a plurality of sources of fluid components for producing a heat treating atmosphere for cementation or carbonitridation;

for the nitrogen component, a generator for separating nitrogen from air by adsorption or selective permeation;

means for adjusting the rate of extraction of nitrogen at at least two levels, including an operating level with a residual content of oxygen of about 2% and a flushing level with a residual content of oxygen less than 0.3%.

4. Apparatus according to claim 3 wherein the residual content of oxygen at the flushing level is between 0.1% and 0.2%.

5. Apparatus according to claim 3 wherein the nitrogen generator feeds a production line, said production line including a first flow reducer and a buffer-tank, and, a second flow reducer interposed between said first flow reducer and said buffer-tank.

6. Apparatus according to claim 5 further comprising a second tank arranged in parallel to said buffer-tank.

7. Apparatus according to claim 5 further comprising a flow meter upstream of said buffer-tank.

8. Apparatus according to claim 5 further comprising an additional nitrogen feeding line, said additional nitrogen feeding lien comprising a liquid nitrogen tank, an evaporator, and a pressure reducer, said additional feeing line communicating with said production line upstream of said buffer-tank.

9. A process for flushing a furnace having unlined walls made of refractory bricks prior to restarting a heat treatment of metallic pieces by cementation, carbonitridation or heating under a treating atmosphere comprising nitrogen and methanol wherein nitrogen is produced by separation from air with an adsorption or permeation generator providing, in normal full flow operating conditions, a nitrogen gas having a residual content of oxygen of about 2%, comprising:

introducing flushing nitrogen into said furnace at a flow which is substantially lower than normal operating flow of nitrogen through said furnace; and accordingly adjusting said generation of nitrogen at a lower extraction rate such that the residual content of oxygen in said flushing nitrogen does not exceed 0.3%.

* * * * *

UNITED STATES PATENT AND TRADEMARK OFFICE

CERTIFICATE OF CORRECTION

PATENT NO. : 5,045,126

DATED : September 3, 1991

INVENTOR(S) : Combier, et. al.

It is certified that error appears in the above-indentified patent and that said Letters Patent is hereby corrected as shown below:

Title page, items [19] replace "Comier et al" with --Combier et al--.
[75] after "Inventors:", replace "Alain Comier" with--Alaim Combier--.

Signed and Sealed this

Fourteenth Day of February, 1995

*Attest:*

*Attesting Officer*

BRUCE LEHMAN

*Commissioner of Patents and Trademarks*